US005442855A

United States Patent [19]

Jobin

[11] Patent Number: 5,442,855

[45] Date of Patent: Aug. 22, 1995

[54] POCKET KNIFE WITH LOCKABLE BLADE

[75] Inventor: Jacques Jobin, Levis, Canada

[73] Assignee: Wenger SA, Switzerland

[21] Appl. No.: 265,066

[22] Filed: Jun. 28, 1994

[30] Foreign Application Priority Data

Jul. 12, 1993 [EP] European Pat. Off. ..... 93810494

[51] Int. Cl.[6] ..... B26B 1/04

[52] U.S. Cl. ..... 30/161; 30/160; 7/118

[58] Field of Search ..... 30/161, 160, 158, 143, 30/152, 159; 7/118, 119, 120

[56] References Cited

U.S. PATENT DOCUMENTS

| | | | |
|---|---|---|---|
| 2,188,762 | 1/1940 | Schrade | 30/160 |
| 4,240,201 | 12/1980 | Sawby et al. | 30/161 |
| 4,535,539 | 8/1985 | Friedman et al. | 30/161 |
| 4,670,984 | 6/1987 | Rickard | 30/161 |
| 4,947,552 | 8/1990 | Barnes | 30/160 X |
| 4,985,998 | 1/1991 | Howard | 30/160 x |

*Primary Examiner*—Eugenia Jones
*Attorney, Agent, or Firm*—Goodman & Teitelbaum

[57] ABSTRACT

The knife comprises a locking strip (2), one end of which can be fitted in an anchoring point (6) of the blade (4), and an unlocking device (1) whereby, when a push button (10) is actuated, the strip can be disengaged from the anchoring point so that the blade can pivot freely.

4 Claims, 2 Drawing Sheets

POCKET KNIFE WITH LOCKABLE BLADE

Figure 1A:
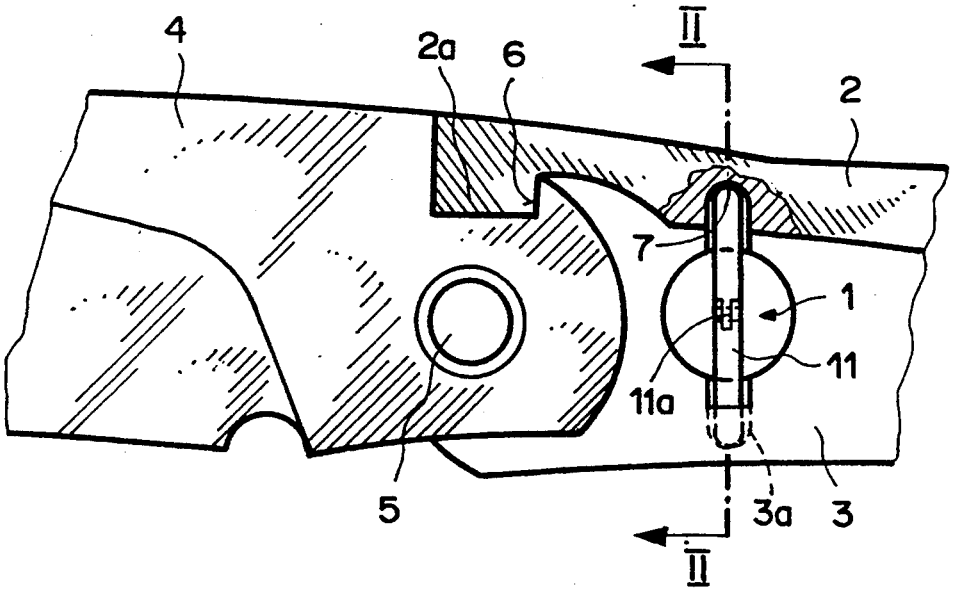

This invention relates to knives, and more particularly to a lockable-blade pocket knife of the type having a blade capable of pivoting about a pivot, a locking strip, the tip of which can be fitted into an anchoring point of the blade, and an unlocking means, this unlocking means including a push button disposed in one of the faces of the knife, capable of being moved along an axis substantially perpendicular to the plane of the blade, this movement of the push button permitting the strip to be moved away so as to release the tip from the anchoring point.

A number of prior art pocket knives allow locking of the blade in its open position. The knife is thus easier and safer to use.

One prior art locking means consists of a pivoting side strip including a front portion serving as a blocking means and a rear portion serving as a lever arm in order to cause the front portion to be closer to or away from the blade. In order to unlock the knife blade, the user presses on the rear portion of the strip, thus disengaging the front portion and releasing the blade. The force applied by the user is concentrated on a very slender surface which has a tendency to impress itself into the skin, making use thereof uncomfortable. Such a knife has a lateral notch giving access to the rear portion of the strip. Because of this notch, other tools cannot be disposed on this portion of the knife. Moreover, the strip used is very long and takes up substantial space in the handle case of the knife.

Another, more compact locking means has also been proposed, allowing tools to be accommodated on a portion of the handle. By means of a lateral unlocking button disposed on the front portion of the handle, the strip can be moved away to release the knife blade. In order to operate, the button must protrude from the side edge of the handle and provide a lever arm long enough to minimize the force necessary for unlocking. The point of support is therefore relatively distant from the handle. This design presents the risk of scratching the user or even tearing his pockets. Furthermore, the lateral button requires a certain amount of space at the front of the handle, where another tool cannot therefore be disposed.

Another prior art type of knife includes a lateral unlocking strip, the front part of which can be moved parallel to the pivoting axis of the blade. In a resting position, the strip is in contact with the blade and blocks it; when the user presses on the strip, the blade is released and can be retracted. This type of knife likewise needs a side notch in order to make the strip accessible. Once more, therefore, it is impossible to optimize the arrangement of the tools for a multifunction knife.

U.S. Pat. No. 4,985,998 describes a lockable-blade pocket knife of the kind first specified above.

It is an object of this invention to provide an improved lockable-blade pocket knife whereby the above-mentioned drawbacks can be avoided.

To this end, in the knife according to the present invention, of the type initially mentioned, the unlocking means comprises a flexible leaf disposed under the push button and co-operating with the lower face thereof, the end of the leaf opposite the strip being held by a stop and the movable end resting against a point of support of the locking strip, and the free end of the leaf moves in a plane substantially parallel to that of the blade, carrying the strip along under the effect of the movement of the push button.

The inventive lockable-blade pocket knife comprises an unlocking means having the advantage of being very compact. No element (except for the locking strip) is disposed laterally along the knife handle. This is particularly advantageous for a multifunction knife, which thus possesses a maximum of possibilities for distributing the various tools. The very slightly protruding button is discreet, easy to use, and presents no risk of scratching the user or tearing his pockets.

Figure 1B:
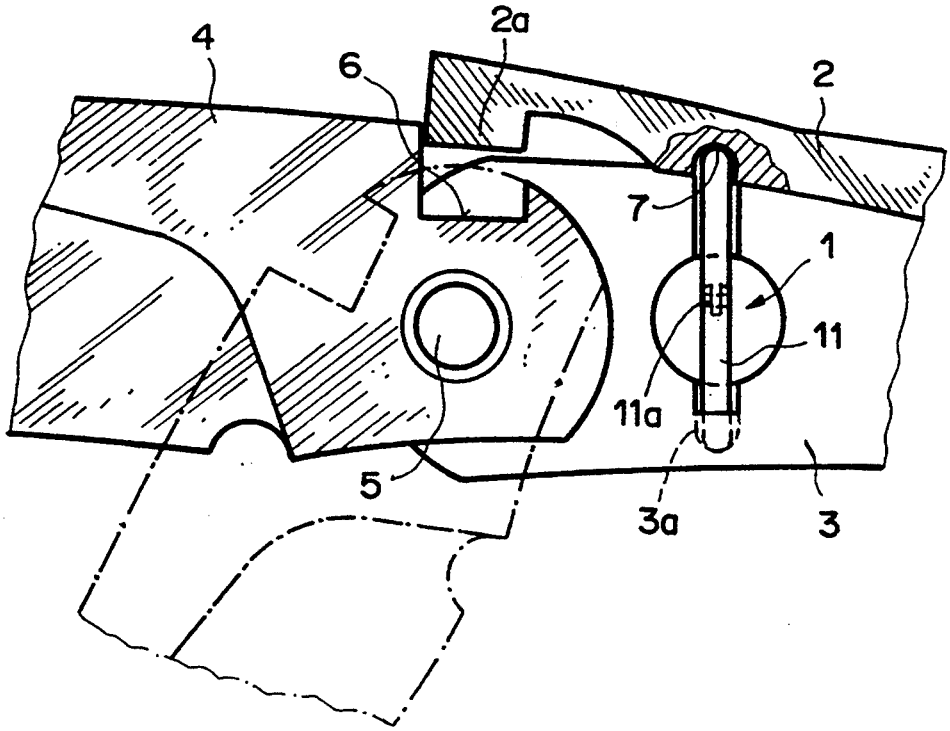
Figure 2B:
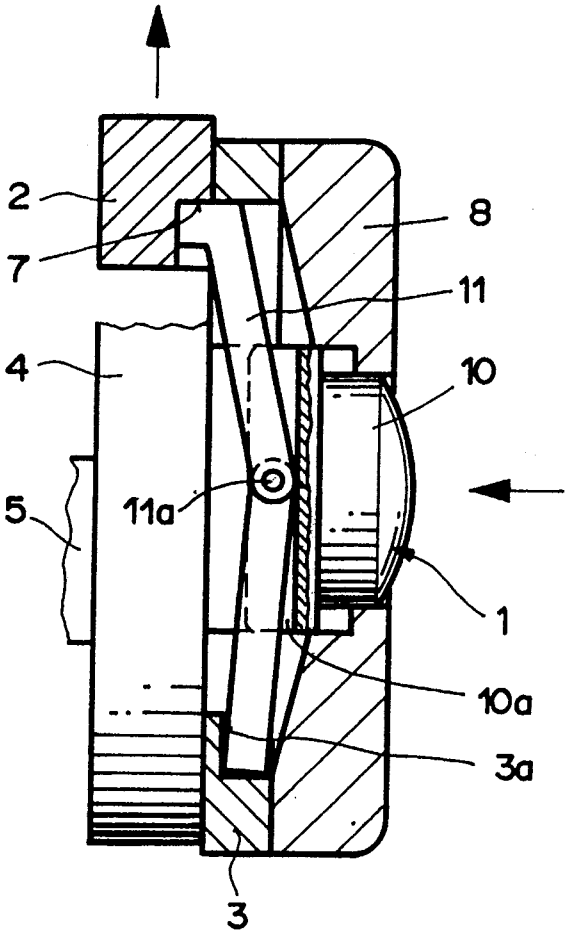
Figure 2A:
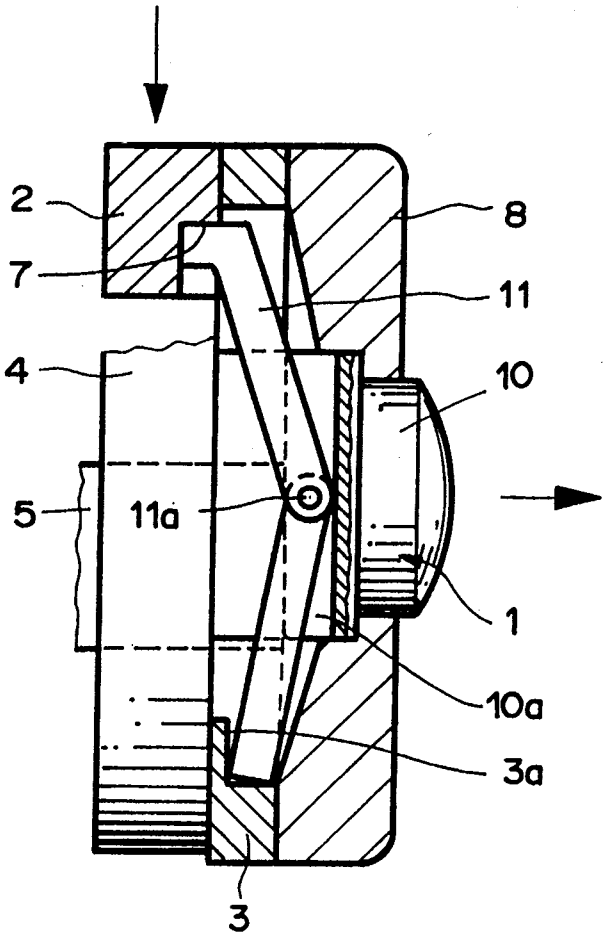

A preferred embodiment of the invention will now be described in detail with reference to the accompanying drawings, in which:

FIG. 1*a* is a longitudinal section through the middle portion of a lockable-blade knife having an unlocking means according to the present invention, the blade being locked, FIG. 1*b* is a section analogous to that of FIG. 1*a*, but with the blade unlocked, FIG. 2*a* is a cross-section taken on the line II—II of FIG. 1*a* with the blade locked, and FIG. 2B is a section analogous to that of FIG. 2*a*, but with the blade unlocked.

FIGS. 1*a* and 2*a* illustrate a lockable-blade knife having an unlocking means according to the present invention, the blade being locked in its open position. The knife comprises a blade 4 having a cutting portion, the flat side of which defines a plane to be referred to hereafter as "the plane of the blade." Blade 4 pivots about a pivot 5 substantially perpendicular to the plane of the blade and situated at the junction between blade 4 and the handle of the knife. The knife further comprises a spring-biased locking strip 2, of a type known per se, disposed laterally along the handle of the knife in a plane substantially parallel to the plane of the blade. The tip 2*a* of locking strip 2 co-operates with an anchoring point 6 of blade 4 when the latter is in an open position; blade 4 is then locked in this position.

The knife also comprises an unlocking means 1 provided with a push button 10 (FIG. 2) and with a flexible leaf 11, preferably in two parts joined by a pivot 11*a*. Push button 10 is disposed in one of the side faces 8 of the knife and can be moved along an axis substantially perpendicular to the plane of the blade. Flexible leaf 11 is disposed under push button 10, pressing against the underside thereof. One end of leaf 11 rests against a point of support 7 of locking strip 2. The other end is held fixed in a notch 3*a* made in the intermediate wall 3 of the knife handle. Thus, when the user presses on push button 10, owing to a movement of the latter toward the inside of the handle along an axis substantially perpendicular to the plane of blade 4, flexible leaf 11 tends to move away; the free end thereof moves in a plane substantially parallel to the plane of blade 4 and acts against support face 7 to displace strip 2 and release tip 2*a* from anchoring point 6. Blade 4 is then free to pivot about pivot 5.

The arrows in FIGS. 2*a* and 2*b* illustrate the principal forces:

- in FIG. 2*a*, locking strip 2 pushes against flexible leaf 11, which keeps push button 10 in a lifted position;
- in FIG. 2*b*, when the user presses on push button 10, strip 2 is pushed away.

In a modification, push button 10 may include a groove 10*a*, made at the level of its underside, so that flexible leaf 11 can partially overlap in push button 10.

What is claimed is:

1. A lockable-blade pocket knife of a type having at least one pivot, a blade capable of pivoting about said pivot and including an anchoring location, a blade-locking strip having a tip adapted to fit into said anchoring location, and unlocking means including a push button disposed in one face of the knife, so that actuation of said push button moves said push button in a direction substantially perpendicular to a plane of a flat side of said blade for releasing said strip from said anchoring location, wherein the improvement comprises:

a flexible leaf being part of said unlocking means, said leaf being disposed under said push button, and co-operating with a lower face of said push button, stop means for holding an end of said leaf remote from said strip, a support portion being part of said strip, an opposite end of said leaf nearest said strip resting against said support portion of said strip, and actuation of said push button moving said opposite end of said leaf, in a plane substantially parallel to the plane of said flat side of said blade, to move said strip so that said strip is caused to move by the actuation of said push button to release said strip from said anchoring location.

2. A pocket knife according to claim 1, wherein said leaf includes two parts, a pivot pin joins said two parts together.

3. A pocket knife according to claim 2, including a knife handle, said unlocking means being disposed in said knife handle, said unlocking means having a construction to permit said knife handle to have various tools therein to define a multifunction knife.

4. A pocket knife according to claim 1, including a knife handle, said unlocking means being disposed in said knife handle, said unlocking means having a construction to permit said knife handle to have various tools therein to define a multifunction knife.

* * * * *